US005902439A

United States Patent [19]

Pike et al.

[11] Patent Number: 5,902,439

[45] Date of Patent: May 11, 1999

[54] SELF-ADHESIVE STAMPS

[75] Inventors: John Alec Pike, N. Uxbridge; William James Dorricott, High Wycombe, both of United Kingdom

[73] Assignee: De La Rue International Limited, London, United Kingdom

[21] Appl. No.: 08/716,335

[22] PCT Filed: Mar. 9, 1995

[86] PCT No.: PCT/GB95/00506

§ 371 Date: Sep. 27, 1996

§ 102(e) Date: Sep. 27, 1996

[87] PCT Pub. No.: WO95/27278

PCT Pub. Date: Oct. 12, 1995

[30] Foreign Application Priority Data

Mar. 30, 1994 [GB] United Kingdom ..... 9406307

[51] Int. Cl.[6] ..... G09F 3/04

[52] U.S. Cl. ..... 156/252; 40/638; 40/630; 156/267; 156/277; 156/291; 283/71

[58] Field of Search ..... 40/630, 638; 156/252, 156/267, 277, 291; 446/108; 283/71

[56] References Cited

U.S. PATENT DOCUMENTS

| | | | |
|---|---|---|---|
| 2,360,973 | 10/1944 | Pedersen | 156/291 X |
| 2,377,572 | 6/1945 | Pedersen | 446/108 X |
| 2,400,208 | 5/1946 | Paige | 446/124 X |
| 2,636,297 | 4/1953 | Johnson | 156/291 X |
| 2,984,342 | 5/1961 | Smith | 156/291 X |
| 4,188,251 | 2/1980 | Grass et al. | 156/277 X |
| 4,214,024 | 7/1980 | Jacobson | 156/291 X |
| 4,488,922 | 12/1984 | Instance | 156/277 X |
| 4,606,959 | 8/1986 | Charbonneau et al. | 40/638 X |
| 4,749,432 | 6/1988 | Ando et al. | 156/291 X |
| 5,182,138 | 1/1993 | Matsuzawa et al. . | |
| 5,225,022 | 7/1993 | Baker et al. | 156/291 X |
| 5,240,789 | 8/1993 | Breen et al. | 40/638 X |
| 5,351,426 | 10/1994 | Voy et al. | 40/630 X |
| 5,536,546 | 7/1996 | Nash | 156/252 X |

FOREIGN PATENT DOCUMENTS

| | | | |
|---|---|---|---|
| 0 358 341 | 3/1990 | European Pat. Off. . | |
| 26 26 704 | 12/1977 | Germany . | |
| 42 15 834 | 11/1993 | Germany . | |
| 741657 | 12/1955 | United Kingdom | 156/291 |
| 876101 | 8/1961 | United Kingdom | 156/252 |
| 1 414 777 | 11/1975 | United Kingdom . | |
| 2 084 817 | 12/1980 | United Kingdom . | |
| 2 083 376 | 3/1982 | United Kingdom . | |
| 2 244 674 | 12/1991 | United Kingdom . | |

*Primary Examiner*—Brian K. Green
*Assistant Examiner*—Andrea Chop
*Attorney, Agent, or Firm*—Brinks Hofer Gilson & Lione

[57] ABSTRACT

Self-adhesive stamps comprising: a layer (2) of stamp paper bearing a printed stamp design on its front and having perfoated edges (6), a layer of pressure-sensitive adhesive (5) on the back of the stamp paper, and a peelable backing sheet (7) covering the adhesive, wherein the pressure-sensitive adhesive layer is patterned such that there is little or no adhesive adjacent to the perorated edges of the stamp paper. Preferably, the pressure-sensitive adhesive is a hot-melt adhesive, and preferably the adhesive is applied by printing. Also a method of making such stamps comprising the steps of: providing a sheet or web of stamp paper having lines of perforations defining stamps therein, followed by coating the back of the stamp paper with a patterned layer of pressure-sensitive adhesive and a peelable backing sheet.

15 Claims, 2 Drawing Sheets

FIG.1
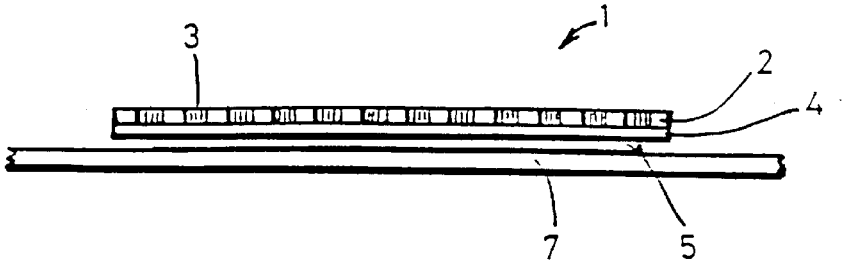
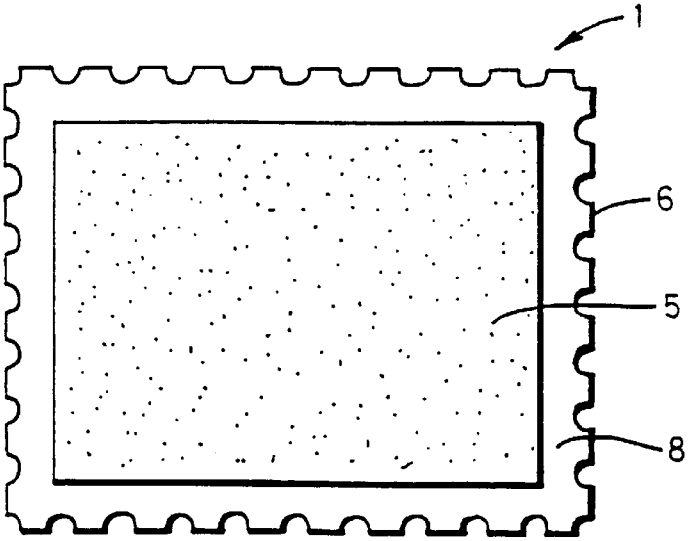
FIG.2
FIG.4
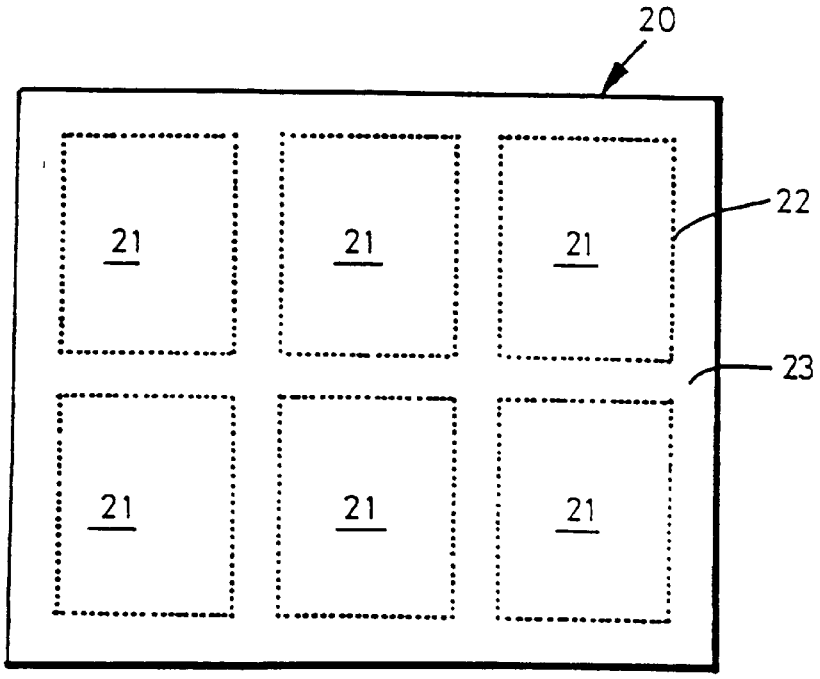

SELF-ADHESIVE STAMPS

The present invention relates to self-adhesive stamps which may be used for a variety of purposes, such as fiscal stamps, redemption stamps, savings stamps, gift stamps etc. In particular, it relates to self-adhesive postage stamps.

Conventional postage stamps are provided with a backing layer of water-soluble adhesive that must be moistened prior to affixing the postage stamps to an envelope or mail piece. In recent years, a demand has developed for self-adhesive postage stamps provided with a coating of pressure-sensitive adhesive that does not need to be moistened prior to use. Such self-adhesive stamps are merely peeled off a releasable backing sheet and then pressed onto an envelope or mail piece. The layer of pressure-sensitive adhesive forms a bond between the stamp and the mail piece substrate. In this way, the mess and unreliability of the moistening step necessary with conventional postage stamps is avoided.

Existing self-adhesive postage stamps are manufactured from self-adhesive label stock or purpose-prepared self-adhesive stock. The self-adhesive stock consists of a sheet of coated paper bonded to a peelable backing sheet by a layer of pressure-sensitive adhesive. The backing sheet can be peeled off (or the stamp can be peeled from a backing board) to expose the pressure-sensitive adhesive, which has been applied as an all-over coating. The pressure-sensitive adhesive is normally an aqueous based polymer adhesive. The self-adhesive postage stamps are manufactured from the said adhesive stock by, first, printing a plurality of postage stamp designs on the prepared stock, followed by die cutting the coated paper (but not normally the backing sheet) along the edges of the postage stamp designs, so that individual postage stamps can be peeled off the backing. Self-adhesive postage stamps made in this way are currently available in several countries, including France, Australia and the U.S.A..

Self-adhesive stamps comprising a layer of stamp paper and a layer of pressure-sensitive adhesive mounted on a backing sheet are described in GB-A-1414777, GB-A-2048817 and DE-A-4215834.

The self-adhesive postage stamps made as described above suffer from numerous drawbacks. First, the coated paper used for making label stock is not normally ideally suitable for high quality postage stamps. When printing on paper which is part of a self-adhesive sandwich it is seldom possible to obtain the best print quality. The coating on the paper may or may not contain the luminescent compounds conventionally included on postage stamp papers for recognition by automatic sorting machines. Still more importantly, the cancellation marks applied to the stamps by the Post Office can sometimes be wiped off the coated papers used for making the self-adhesive stock.

A second drawback of the above method is the impracticality of making traditional perforation holes with the adhesive and release backing in situ. The problem is that the pieces of adhesive-coated paper punched out by a conventional perforating die tend to stick together in unmanageable clumps that obstruct the perforating machinery. This means that the self-adhesive stamps obtained by the above process do not currently have perforated edges. That is to say, they do not have edges with the characteristic profile produced by tearing or die cutting along a line of perforations (such as a line of circular holes approximately 0.75–1.2 mm in diameter spaced 0.2–0.8 mm apart, measured between edges of adjacent holes). The absence of perforated edges makes forgery of the stamps easier, and results in reduced customer acceptance. This drawback has been addressed by die cutting around the stamps using a die cutting tool having a zig-zag or wave-shaped blade so as to simulate the appearance of perforated edges. However, the stamps produced in this way are always readily distinguishable from stamps having true perforated edges when examined by experienced persons.

A third drawback of self-adhesive stamps produced according to the existing art is leakage of adhesive through the die-cut lines in the stamp paper. This leakage of adhesive can cause unwanted adhesion between stacked or coiled sheets of the self-adhesive stamps.

A fourth drawback of self-adhesive stamps produced according to the existing art is that the combined thickness of the coated paper, adhesive and backing sheet is difficult to fold into the neatly folded sheets dispensed by postage stamp vending machines or sold in booklets or wallets at Post Offices and other retail outlets.

According, it is an object of the present invention to provide improved self-adhesive stamps that overcome the above drawbacks of the existing art. It is a further object of the present invention to provide a simple, efficient and productive method of making such improved self-adhesive stamps. The method permits the manufacture of the whole range of conventional stamp based products currently being produced world-wide in self-adhesive forms without variation to the print method, print quality, quality of perforation holes or the overall visual appearance.

The present invention provides a self-adhesive stamp comprising: a layer of stamp paper having perforated edges; a layer of pressure-sensitive adhesive on the back of the stamp paper; and a peelable backing sheet covering the adhesive, characterized in that the pressure-sensitive adhesive layer is patterned such that there is substantially no adhesive adjacent to the perforated edges of the stamp paper.

The term "perforated edges" means that the edges of the stamp paper have the characteristic profile produced by tearing or die cutting along a line or perforations. The said perforations may be circular, polygonal, star shaped or of more complex shapes. However, preferably the perforations are circular. Preferably, the circular perforations have a diameter of 0.75–1.2 mm and are spaced 0.2–0.8 mm apart, measured between edges of adjacent holes.

The provision of self-adhesive stamps having genuinely perforated edges is an important feature of the present invention. Such self-adhesive stamps are harder to forge than previous self-adhesive stamps, and are more acceptable to the public.

Preferably, the stamp is a postage stamp. Preferably, the stamp forms part of a sheet or coil of stamps, in which the individual stamps are preferably separated from each other by lines of perforations. The stamps according to the present invention could form part of a sheet or coil of stamps that further comprises stamps not falling within the scope of the invention, for example stamps having only a layer of moistenable adhesive.

The term "stamp paper" encompasses any kind of paper suitable for the manufacture of stamps. Preferably, the front face of the stamp paper is provided with a coating that contains, in addition to other components, luminescent pigments for recognition by automatic facing, cancelling and sorting machines. Preferably, the front surface of the stamps is printed with a stamp design, such as a postage stamp design. Preferably, the front face of the stamp paper is coated in such a way that it permanently retains cancellation marks applied to the paper by the Post Office or user authority. In fact, the stamp paper is preferably similar to, or the same as, the paper conventionally used for the manufacture of postage stamps bearing a water-soluble adhesive coating.

In certain preferred embodiments, the security of the stamp is enhanced by providing shaped perforations, known as perfins, in the central part of the stamp paper remote from the perforated edges.

The pressure-sensitive adhesive may comprise any of the adhesives of this type commonly known in the art. For example, the pressure-sensitive adhesive may be a water-soluble acrylic adhesive. However, preferably, the pressure-sensitive adhesive is a hot-melt adhesive. The pressure-sensitive adhesive can be applied by any methods that imparts a controlled pattern to the adhesive.

Preferably, the layer of pressure-sensitive adhesive is printed or slot coated on the back of the stamp paper, or in some cases may be similarly applied to the backing sheet and then laminated to the rear of the stamps. The pressure-sensitive adhesive does not cover the whole of the back surface of the stamp paper, but instead is patterned such that there is little or no adhesive adjacent to the perforated edges of the stamp paper. Preferably, an adhesive-free margin of 0.1 to 5 mm, more preferably 1 to 4 mm, is left between the perforated edges of the stamp paper and the edge of the pattern of pressure-sensitive adhesive. This ensures that no adhesive leaks through the perforations to the front face of the stamps. Furthermore, this makes it easier to peel the stamps away from the backing sheet, since the edges of the stamps are not adhered to the backing sheet.

Preferably, the peelable backing sheet is a release-coated paper, such as a silicone-coated paper. Also preferably, the backing sheet may be a polymer film, such as a biaxially oriented polypropylene film, which may have been silicone coated.

Preferably, the self-adhesive stamp according to the present invention further comprises a layer of water-releasable adhesive intercalated between the stamp paper and the layer of pressure-sensitive adhesive. Preferably, the water-releasable adhesive is a moistenable adhesive of the kind conventionally used for postage stamps. The purpose of this intermediate layer of water-releasable adhesive is to make it possible for philatelists to remove the stamp from an envelope by steaming or soaking. This is difficult and not particularly efficient if there is only a layer of pressure-sensitive adhesive between the stamp paper and the envelope or postal item.

The present invention also provides a method of making a self-adhesive stamp comprising the steps of: providing a web or sheet of stamp paper and providing lines of perforations in the stamp paper defining a plurality of stamps, followed by applying a layer a layer of pressure-sensitive adhesive and a peelable backing sheet to the back of the stamp paper, characterized in that the pressure-sensitive adhesive is applied in a pattern such that there is substantially no adhesive applied to the back of the stamps adjacent to the lines of perforation.

Preferably, the stamp paper is a conventional stamp paper of the kind used to print conventional postage stamps. Such paper is preferably provided with a continuous layer of moistenable adhesive on the back thereof.

Preferably, the pressure-sensitive adhesive layer is applied to the back of the perforated stamp paper, and the adhesive coated, perforated layer is then laminated to the peelable backing sheet. However, it is also possible to coat the pressure-sensitive adhesive layer onto the backing sheet and then laminate the coated backing sheet onto the stamp paper.

The method of the present invention offers the advantage that the stamps can be printed using conventional web or sheet printing techniques, such as web gravure printing, on conventional stamp paper that is optimised for such printing and which can also be provided with suitable luminescent coatings for recognition by automatic sorting machines. The printing can be carried out before the perforation step, or it may preferably be carried out following the step of applying the pressure-sensitive adhesive and the backing sheet.

The pressure-sensitive adhesive is preferably a hot-melt adhesive. This is preferable because the hot-melt adhesive can be applied in one step, without any need for subsequent drying of the adhesive thus having minimal impact on the stamp stability. In contrast, conventional acrylic or other polymer pressure-sensitive adhesive is normally applied in aqueous solution and then dried. This involves an additional step of drying, and the water (or other solvents used) can cause wrinkling, distortion or other problems with the stamp paper. The pressure-sensitive adhesive may be applied to the back of the stamp paper or to the backing sheet by any conventional means for applying a patterned layer, such as a nozzle, slot die or roller. Preferably, the pressure-sensitive adhesive is applied to the back of the stamp paper or to the backing sheet by printing, more preferably screen printing. This permits accurate patterning of the layer of pressure-sensitive adhesive. In particular, it allows the pressure-sensitive adhesive to be applied in a pattern such that there is no adhesive adjacent to the perforated edges around each stamp. Preferably, an adhesive-free margin of width 0.1–5 mm, more preferably 1–4 mm, is left on the back of each stamp around the perforated edges of each stamp. The advantages of such a patterned adhesive layer are described above.

Following the application of the adhesive layer and backing sheet, the method preferably further comprises the step of die cutting the web of stamp paper along one or more of the lines of perforations. This allows individual stamps to be lifted off the backing sheet. The line of the die cut is preferably a straight line running down the middle of the lines of perforations, whereby the stamps are provided with the characteristic perforated edge profile of conventional stamps.

The resulting web of self-adhesive stamps adhered to the backing sheet can be cut into smaller sheets and/or wound into coils or made into books or wallets. The web can also be folded readily along the lines of perforations provided in the stamp paper. This folding is preferably assisted by the provision of lines of weakness such as score lines or lines of perforations in the backing sheet corresponding to the desired fold lines.

Preferably, the self-adhesive stamps are made in a spaced-apart arrangement on the backing sheet, thereby making the stamps easier to detach from the backing sheet and making it easier to fold up the sheet of stamps. Alternatively for non-spaced apart stamp material the backing paper is offset in register to further facilitate peeling by the user. The spaced-apart stamps are made by printing the plurality of stamp designs on the web of stamp paper in a corresponding spaced-apart arrangement with a carcase of blank stamp paper defined by the lines of perforations around the stamp designs. Then, following the application of the peelable backing sheet and the adhesive layer, the stamp paper is die cut along the lines of perforations and the carcase is lifted off, thereby leaving a plurality of stamps attached to the backing sheet in spaced-apart fashion. Preferably, little or no pressure-sensitive adhesive is applied to the back of the carcase, thereby making the carcase easy to separate from the backing sheet, easy to remove and wind up and easy to dispose of. This is an important advantage of the method of the present invention.

Specific embodiments of the self-adhesive stamps and method of their manufacture according to the present invention will now be described further, by way of example, with reference to the accompanying drawings, in which:

FIG. 1 shows a side elevation view of the stamp according to the present invention (relative vertical dimensions have been exaggerated for the sake of clarity);

FIG. 2 shows a rear plan view of the stamp of FIG. 1 with the backing sheet removed;

FIG. 4 shows a plan view of a small part of a printed stamp paper web for use in the method of making self-adhesive stamps that are spaced apart on a backing sheet.

Figure 3:
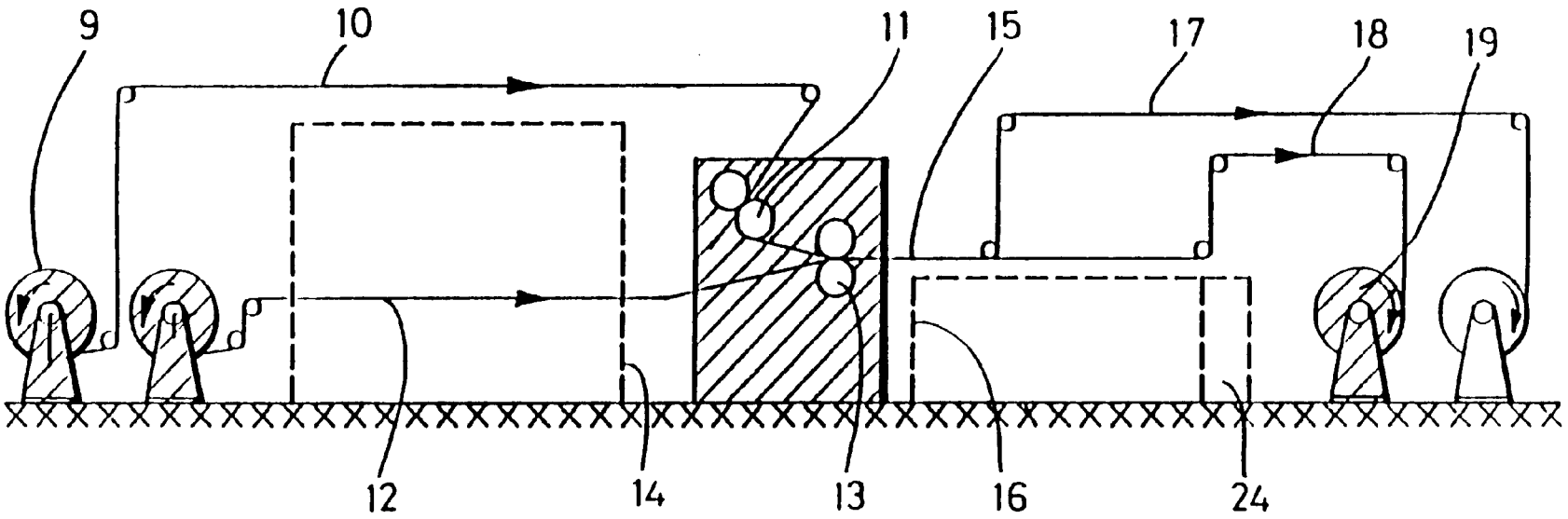
FIG. 3 shows a schematic view of steps in a method of manufacture of a self-adhesive stamp (excluding the printing and final finishing) according to the present invention.

Referring to FIG. 1, the self-adhesive stamp (1) comprises a layer of stamp paper (2) of the type conventionally used for printing postage stamps according to the existing art that are provided with a layer of moistenable water-soluble adhesive only. A postage stamp design is printed on the front surface (3) of the stamp paper, and the front of the stamp paper can also be coated with a luminescent organic (or inorganic) pigment for recognition by automatic sorting machines. The back face of the stamp paper is entirely coated with a layer (4) of moistenable water-releasable adhesive of the kind that is applied to conventional postage stamps. Beneath the layer (4) of moistenable water-releasable adhesive, there is provided a layer (5) of hot-melt pressure-sensitive adhesive. The layer (5) of pressure-sensitive adhesive does not extend all the way to the edges (6) of the stamp paper. The hot-melt adhesive is a synthetic thermoplastic rubber based adhesive for application at 150 to 170° C. and available from The National Starch Chemical Company Limited under catalog reference no. 089-1540. The weight of the hot-melt adhesive is 10 to 25 grams per square meter, preferably 15 to 20 grams per square meter, more preferably about 17½ grams per square meter. The layer (5) of pressure-sensitive adhesive is covered by a peelable backing sheet (7) of silicone release-coated paper. The particular paper used in this embodiment is available from Cotek Limited under reference BB 45, and has a weight of 45 grams per square meter.

Referring to FIG. 2, it can be seen that the stamp (1) has perforated edges (6) formed by making a straight cut along the centre of a line of circular perforations. The layer (5) of pressure-sensitive adhesive is screen printed in a rectangular pattern in the centre of the stamp, leaving a margin (8) approximately 3 mm wide free from adhesive around the edges of the stamp. This prevents leakage of the adhesive around the perforated edges of the stamp to the front face of the stamp, and also makes peeling of the stamp from the backing sheet easier.

Referring to FIG. 3, the self-adhesive stamps are made as follows. First, a web of stamp paper having its back surface entirely coated with conventional water-releasable postage stamp adhesive is printed with a plurality of stamp designs on one face and perforated in the same fashion as for the manufacture of conventional stamps. This produces a roll (9) of printed and perforated web. In alternative embodiments, the printing step can be omitted or left until a later stage in the process. The web (10) is then unwound from the roll (9) and continuously fed into a screen printer (11) that prints the pattern of hot-melt adhesive on the back face of the stamp paper, in register with the printed stamp designs. The screen printer (11) is a hot melt screen printer available from Meltex GmbH of Lüneburg, Germany or Nordson Corporation, Norcross, Atlanta, U.S.A. Following the screen printing step, a continuous web (12) of the backing sheet material is applied to the adhesive-coated surface of the stamp paper web by rollers (13). Optionally, the backing sheet is printed by a web printer (14) before being applied to the stamp paper web. The resulting sandwiched web (15) then enters a die cutting apparatus (16), in which die cuts are made through the stamp paper along some or all of the lines of perforations in the stamp paper. Where appropriate, the carcase (17) of stamp paper between spaced-apart stamps is then stripped off and wound up. The web of backing sheet material having the self-adhesive stamps thereon (18) is wound up into a coil (19) or can be sheeted at (24). The coil (19) can then undergo further processing to prepare sheets, folded sheets, wallets or other retail formats. In alternative embodiments, printing of the stamp designs on the front face of the stamps can take place at this stage.

FIG. 4 shows in detail a section of the perforated, printed web (20) of stamp paper that is used to make stamps according to the present invention spaced-apart on a supporting sheet of peelable backing material. The web has individual stamp designs (21) printed in spaced-apart fashion with lines of perforations (22) around each stamp design (21). In the adhesive coating step, the hot-melt adhesive is printed onto the back of the stamp paper web only on the underside of the stamp designs (21). The backing sheet is then applied, followed by die cutting along the lines of perforations (22). The carcase (23) of stamp paper between the individual stamps can then simply be lifted off, leaving the individual stamps spaced-apart on the backing sheet. The carcase is rolled up and disposed of, or recycled.

The above specific embodiments of the present invention have been described by way of example only. Many other embodiments falling within the scope of the accompanying claims will be apparent to the skilled reader.

We claim:

1. A method of making a self-adhesive stamp comprising the steps of:

providing a web or sheet of stamp paper and providing lines of perforations in the stamp paper defining a plurality of stamps, followed by applying a layer of pressure-sensitive adhesive and a peelable backing sheet to a back face of the stamp paper, wherein the pressure-sensitive adhesive is applied in a pattern such that there is little or no adhesive applied to back faces of the stamps adjacent to the lines of perforations:

wherein the step of applying comprises the steps of: coating the layer of pressure-sensitive adhesive onto the back face of the perforated stamp paper, followed by laminating the backing sheet onto the coated and perforated stamp paper.

2. A method according to claim 1, wherein a plurality of stamp designs are printed on the web or sheet of stamp paper before the lines of perforations are provided in the stamp paper.

3. A method according to claim 1, wherein a plurality of stamp designs are printed on the web or sheet of stamp paper after the steps of providing lines of perforations and applying, and in register with the plurality of stamps.

4. A method according to claim 1, wherein the pressure-sensitive adhesive is a hot-melt adhesive.

5. A method according to claim 1, wherein the layer of pressure-sensitive adhesive is coated onto the back face of the stamp paper by screen printing.

6. A method according to claim 1, further comprising the step of, following the application of the backing sheet with die cutting the web of stamp paper along one or more of the lines of perforations.

7. A method according to claim 1, further comprising the step of die cutting the backing sheet or perforating the backing sheet.

8. A method of making a self-adhesive stamp comprising the steps of:

providing a web or sheet of stamp paper and providing lines of perforations in the stamp paper defining a plurality of stamps, followed by applying a layer of pressure-sensitive adhesive and a peelable backing sheet to a back face of the stamp paper, wherein the pressure-sensitive adhesive is applied in a pattern such that there is little or no adhesive applied to back faces of the stamps adjacent to the lines of perforations, and wherein an adhesive-free margin of 0.1–5 mm width is left on the back faces of the stamps adjacent to the lines of perforations; and wherein the step of applying comprises the steps of: coating the layer of pressure-sensitive adhesive onto the back of the perforated stamp paper, followed by laminating the backing sheet onto the coated and perforated stamp paper.

9. A method of making a self-adhesive stamp comprising the steps of:

providing a web or sheet of stamp paper and providing lines of perforations in the stamp paper defining a plurality of stamps followed by applying a layer of pressure-sensitive adhesive and a peelable backing sheet to a back face of the stamp paper, wherein the pressure-sensitive adhesive is applied in a pattern such that there is little or no adhesive applied to back faces of the stamps adjacent to the lines of perforations; and wherein the plurality of stamps are spaced apart on the stamp paper, with a carcase of stamp paper between the stamps defined by the lines of perforations around the stamps, and the method further comprises the steps of: following the application of the peelable backing sheet with die cutting along the lines of perforations and lifting off the carcase, thereby leaving a plurality of stamps attached to the backing sheet in spaced-apart fashion.

10. A method according to claim 9, wherein the pressure-sensitive adhesive is a hot-melt adhesive.

11. A method according to claim 9, wherein the layer of pressure-sensitive adhesive is coated on to the back face of the stamp paper or onto the backing sheet by screen printing or slot die coating.

12. A method according to claim 9, wherein a plurality of stamp designs are printed on the web or sheet of stamp paper before the lines of perforations are provided in the stamp paper.

13. A method according to claim 9, wherein a plurality of stamp designs are printed on the web or sheet of stamp paper after the steps of providing line of perforations and applying, and in register with the plurality of stamps.

14. A method according to claim 9, wherein the step of applying comprises the steps of: coating the layer of pressure-sensitive adhesive on the peelable backing sheet, followed by laminating the coated backing sheet onto the perforated stamp paper.

15. A method of making a self-adhesive stamp comprising the steps of:

providing a web or sheet of stamp paper and providing lines of perforations in the stamp paper defining a plurality of stamps, followed by applying a layer of pressure-sensitive adhesive and a peelable backing sheet to a back face of the stamp paper, wherein the pressure-sensitive adhesive is applied in a pattern such that there is little or no adhesive applied to back faces of the stamps adjacent to the lines of perforations and wherein an adhesive-free margin of 0.1–5 mm width is left on the back faces of the stamps adjacent to the lines of perforations; and wherein the plurality of stamps are spaced apart on the stamp paper, with a carcase of stamp paper between the stamps defined by the lines of perforations around the stamps, and the method further comprises the steps of: following the application of the peelable backing sheet with die cutting along the lines of perforations and lifting off the carcase, thereby leaving a plurality of stamps attached to the backing sheet in spaced-apart fashion.

* * * * *